United States Patent [19]

Rautio

[11] Patent Number: 4,499,934

[45] Date of Patent: Feb. 19, 1985

[54] CUTTER FOR SQUARE TIMBER HEWING MACHINE

[76] Inventor: Kauko Rautio, 52700 Mäntyharju, Finland

[21] Appl. No.: 565,830

[22] Filed: Dec. 27, 1983

Related U.S. Application Data

[63] Continuation of Ser. No. 290,316, Aug. 5, 1981, abandoned.

[30] Foreign Application Priority Data

Aug. 6, 1980 [FI] Finland ..... 802468

[51] Int. Cl.[3] ..... B27C 9/00

[52] U.S. Cl. ..... 144/176; 144/41; 144/162 R; 144/241; 144/220

[58] Field of Search ..... 144/162 R, 172, 174, 144/176, 218, 220, 230, 240, 241, 41, 39

[56] References Cited

U.S. PATENT DOCUMENTS 3,011,535 12/1961 Andrus et al. ..... 144/241
3,304,970 2/1967 Altosapr ..... 144/162 R
3,645,308 2/1972 Nilsson ..... 144/176

*Primary Examiner*—W. D. Bray
*Attorney, Agent, or Firm*—Martin Smolowitz

[57] ABSTRACT

A cutter for square timber hewing, which consists of a cutter disk shaped like a truncated cone and on the mantle surface of which have been affixed cutter bits arranged after each other in helical configuration, so that cutting takes place with each cutter bit in its turn, starting at the outer periphery of the cutter cone and proceeding inward. The cutter bit has two cutting edges which lie on each other's extension and define an obtuse angle. One bit edge moves in parallel with the grain of the timber and the other bit edge moves obliquely with reference to the grain of the timber, hewing of the square timber being effected by feeding the trunk in between two opposing cutters or pairs of cutters. The cutter bit has been affixed to the cutter disk by the extension, pointing towards the center of the cutter disk, of the cutter bit's bit edge cutting in the direction of the grain.

4 Claims, 7 Drawing Figures

CUTTER FOR SQUARE TIMBER HEWING MACHINE

Figure 1:
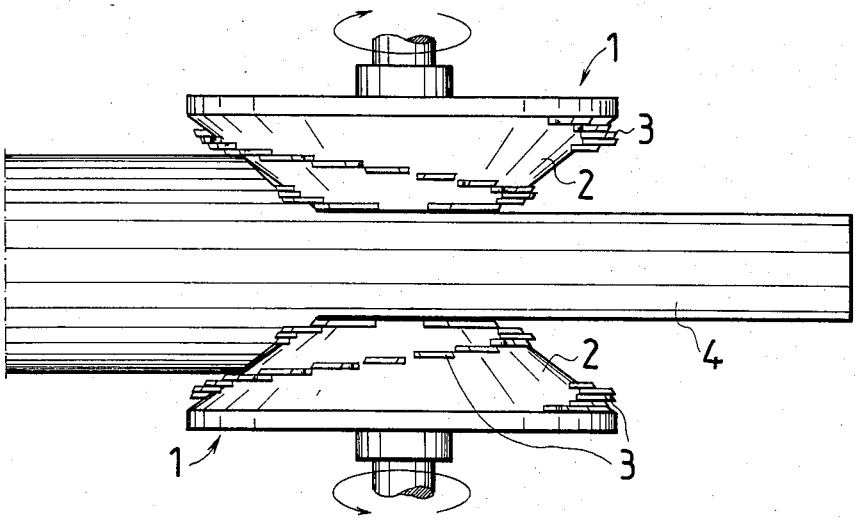

This is a continuation of application Ser. No. 290,316, filed Aug. 5, 1981, now abandoned.

BACKGROUND OF INVENTION

The present invention concerns a cutter for a square timber hewing machine, consisting of a cutter disk shaped liked a truncated cone and on the mantle surface of which have been affixed cutter bits in consecutive succession in helical configuration so that the cutting takes place with each bit in turn, starting at the outer periphery of the cutter disk and proceeding inward. The cutter bit has one curved cutting edge, or two or more cutting edges located on each other's extension and define an obtuse angle, part of the cutting edge (edges) moving parallel to the wood grain and another part moving obliquely against the grain orientation, the square timber hewing operation being accomplished by feeding the trunk into the interstice of opposing cutters or pairs of cutters.

The object of this invention is to provide a new type of cutter by which several advantages are gained over cutters of prior art.

SUMMARY OF INVENTION

The cutter of the invention is characterized in that the cutter bit has been affixed to the cutter disk by an extension, pointing toward the centre of the cutter disk, with a first part of the cutting edge cutting in the direction of the grain of the timber being hewed and a second part of the cutting edge cutting obliquely to the grain.

The mode of affixing the cutter bit to the cutter disk as taught by the invention enables both the cutter and the square timber hewing machine to be constructed about two-thirds smaller and lighter than any solutions known at present. Other advantages include that, one achieves firm attachment of the cutter bits to the cutter disk, simple and rapid cutter bit servicing and replacing, changability of bits in accordance with the hewing behaviour of each timber species, lower energy consumption due to the cutter's small rotating mass, and the possibility to construct the square timber hewing machine to operate with one feeding means, thus enabling the hewing also to be done with observation of the trunk's curvature. The cutter of the invention produces an excellent surface of the finished timber and it detaches chips which are of uniform quality and have a fibre length suitable for instance with a view to their use in the cellulose industry.

When the cutter of the invention is employed, the chips fly to one side, owing to centrifugal force, without catching anywhere or accumulating on projections of the cutter bit and cutter disk, because that cutting edge which is doing cutting work at any given time is, at the point where it is cutting, the outermost part of the cutter bit.

An advantageous embodiment of the invention is characterized in that in the mantle surface of the cutter disk has been made a recess adjacent to the bits edges, to serve as chip accommodation.

Another embodiment of the invention is characterized in that the cutter disk presents, for the cutter bit, a recess conforming to the base of the cutter bit. As a consequence, the cutter bit is held firmly in its place, and invariably in the same place, by one single screw.

DESCRIPTION OF INVENTION

Figure 2:
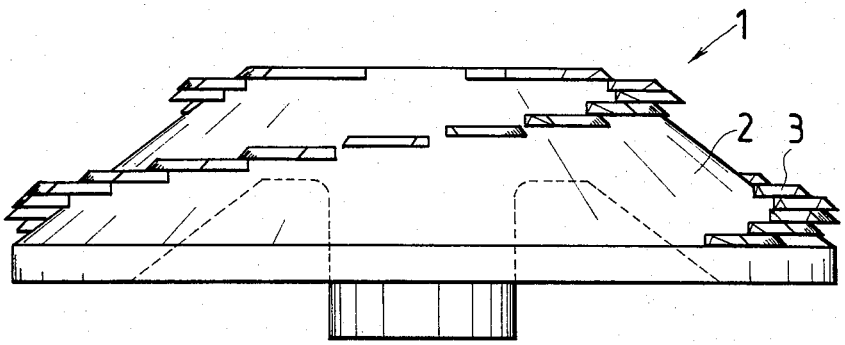

The invention is described in the following, with reference being made to the attached drawings, wherein:

FIG. 1 presents two opposing cutters, and a timber being hewn thereinbetween, FIG. 2 presents the cutter in a plan view.

Figure 3:
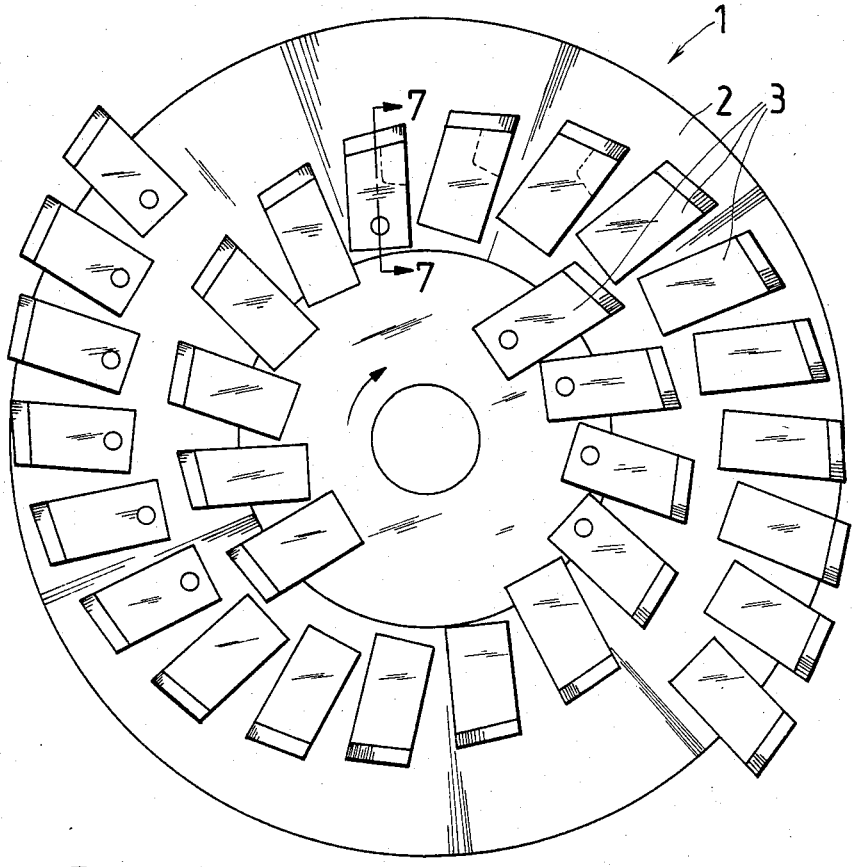

FIG. 3 presents the cutter in end view.

Figure 4:
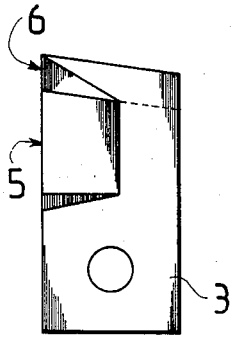
Figure 5:
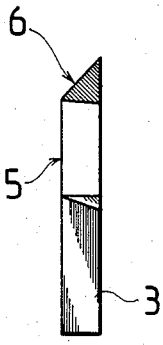
Figure 6:
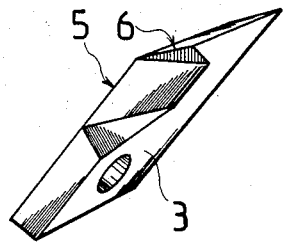

FIGS. 4, 5 and 6 show the cutter bit, viewed from various directions.

Figure 7:
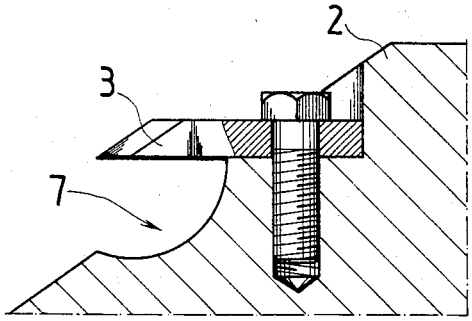

FIG. 7 presents a sectional view taken at line 7—7 of FIG. 3 showing the fixing point of the cutter bit on the cutter disk.

The cutter 1 consists of a cutter disk 2 shaped like a truncated cone and to the mantle surface of which cutter bits 3 are affixed. The square timber hewing is accomplished by feeding the trunk 4 in between two opposed cutters 1 or between two opposed pairs of cutters. The cutter bits 3 have been affixed to the conical surface of the cutter disk 2 in consecutive succession in a helical arrangement so that cutting will take place with each cutter bit 3 in turn, starting at the outer periphery of the cutter disk 2 and proceeding inward. The cutter bits 3 form one or several helices on the mantle surface of the cutter disk 2.

The cutter bit 3 has cutting bit edges 5, 6 lying on each other's extension and defining an obtuse angle therebetween. One bit edge 5 moves in the grain direction of the timber trunk 4 and the other bit edge 6 moves obliquely with reference to the grain of the timber 4. It is seen in FIG. 7 that the cutter bit 3 has been affixed to the cutter disk 2 by that extension 3*a* of the bit edge 5 cutting parallel to the grain and which points toward the centre of the cutter disk 2. The cutter 1 may then be constructed to be of small size and low weight and to operate with only one single tree trunk feeding means.

In the mantle surface of the cutter disk 2, a recess 7 has been provided adjacent to the bit edges 5,6 to serve as chip accommodation. Since the cutting edges 5,6 of the cutter bit 3 are the outermost point of the cutter bit 3 at the point where cutting is in progress at any particular time, the chips will be flung out by centrifugal force action, without sticking and without accumulating on projections of the cutter bit 3 or cutter disk 2. For firm atachment of the cutter bit 3 by the extension towards the cutter disk's 2 centre of the bit edge 5, one screw 8 inserted through hole 9 in cutter bit 3 for instance is sufficient, whereby the servicing and replacement of the cutter bits 3 are fast and simple operations.

It is obvious to a person skilled in the art that different embodiments of the invention may vary within the scope of the claims following below. For instance, the obtuse angle between the cutter bit's bit edges need not necessarily be as shown in the figures: it may equally well be gently curving.

I claim:

1. A cutter for square timber hewing, comprising: a cutter disk shaped like a truncated cone and having a mantle surface; multiple cutter bits affixed to said cutter disk on said mantle surface and arranged in consecutive succession after each other in a helical configuration, so that cutting takes place by each said cutter bit in turn starting at the outer periphery of said cutter disk and proceeding inwardly, each of said cutter bits having two cutting edges which lie on each other's extension and define an obtuse angle therebetween, said cutter bits arranged so that a first bit cutting edge moves parallel with the grain of a timber being cut and the other cutting edge moves obliquely with reference to the grain of the timber, wherein each cutter bit is affixed to the cutter disk so that the cutter bit first edge cutting parallel with the direction of the timber grain extends towards the center of the cutter disk, and an extension of said cutter bit first edge is used to affix said cutter bit to the cutter disk, the mantle surface of the cutter disk being provided with a recess adjacent to the bit cutting edges for chip accommodation and whereby, hewing of the timber is effected by feeding the timber trunk in between two opposing rotating cutters and chips produced from the hewing are flung outwardly without accumulating on any surface of the cutter disk.

2. The cutter according to claim 1, wherein a recess is provided in the cutter disk conical surface for holding each cutter bit, said recess conforming to the shape of the base of the cutter bit.

3. The cutter according to claim 2, wherein each cutter bit is attached to the cutter disk by a single screw.

4. A cutter for square timber hewing, comprising:

(a) a cutter disk shaped like a truncated cone and having an outer mantle surface;

(b) multiple cutter bits affixed to said cutter disk on said mantle surface and arranged in consecutive succession after each other in a helical configuration, so that the cutting takes place with each said cutter bit in its turn starting at the outer periphery of said cutter disk and proceeding inwardly, each said cutter bit having two cutting edges which lie on each other's extension and define an obtuse angle therebetween, said cutter bits arranged so that a first cutting edge moves parallel with the grain of a timber being cut and the other cutting edge moves obliquely with reference to the grain of the timber, wherein each cutter bit is affixed to the cutter disk so that the cutter bit first edge cutting in parallel with the direction of the timber grain extends toward the center of the cutter disk, said cutter bit first edge including means defining an extension thereof, said extension being used to affix said cutter bit to the cutter disk, whereby hewing of the timber is effected by feeding the timber trunk in between two opposing rotating cutters;

(c) multiple recesses provided in the cutter disk conical mantle surface, each recess shaped for receiving and fastening each said cutter bit to the disk; and (d) a recess groove provided in the cutter disk adjacent to each bit cutting edge for chip accommodation, whereby chips produced from the cutting are flung by centrifugal force outwardly and behind the cutter without accumulating on any surface of the cutter disk.

* * * * *